US005582033A

United States Patent [19]

Bonaquist et al.

[11] Patent Number: 5,582,033

[45] Date of Patent: Dec. 10, 1996

[54] CRYOGENIC RECTIFICATION SYSTEM FOR PRODUCING NITROGEN HAVING A LOW ARGON CONTENT

[75] Inventors: Dante P. Bonaquist, Grand Island; Michael Y. Jin, Tonawanda, both of N.Y.

[73] Assignee: Praxair Technology, Inc., Danbury, Conn.

[21] Appl. No.: 619,382

[22] Filed: Mar. 21, 1996

[51] Int. Cl.[6] ..... F25J 3/04

[52] U.S. Cl. ..... 62/643; 62/646; 62/924

[58] Field of Search ..... 62/643, 646, 924

[56] References Cited

U.S. PATENT DOCUMENTS

| | | | |
|---|---|---|---|
| 4,054,433 | 10/1977 | Buffiere et al. | 62/643 |
| 4,778,497 | 10/1988 | Hanson et al. . | |
| 4,822,395 | 4/1989 | Cheung . | |
| 5,133,790 | 7/1992 | Bianchi et al. . | |
| 5,170,630 | 12/1992 | Stern | 62/643 |
| 5,205,127 | 4/1993 | Agrawal . | |
| 5,228,296 | 7/1993 | Howard | 62/924 X |
| 5,245,831 | 9/1993 | Agrawal et al. | 62/924 X |
| 5,255,524 | 10/1993 | Agrawal et al. | 62/924 X |
| 5,275,003 | 1/1994 | Agrawal et al. | 62/924 X |
| 5,345,773 | 9/1994 | Nagamura et al. | 62/649 |
| 5,349,822 | 9/1994 | Nagamura et al. | 62/649 |
| 5,511,380 | 4/1996 | Ha | 62/646 |

*Primary Examiner*—Christopher Kilner
*Attorney, Agent, or Firm*—Stanley Ktorides

[57] ABSTRACT

A cryogenic rectification system for producing nitrogen having a low argon content wherein the reflux ratio in the upper portion of the higher pressure column of a double column system is modified by withdrawing nitrogen vapor from below the top of the column, liquefying the withdrawn vapor, and returning the liquefied nitrogen to the column at or near the withdrawal point and below the top of the column.

10 Claims, 2 Drawing Sheets

CRYOGENIC RECTIFICATION SYSTEM FOR PRODUCING NITROGEN HAVING A LOW ARGON CONTENT

FIELD OF THE INVENTION

This invention relates generally to cryogenic rectification of feed air and, more particularly, to the production of nitrogen.

BACKGROUND ART

In some applications, a portion or all of the liquid nitrogen product from a cryogenic air separation plant is required at a purity higher than normal. More specifically, the shelf liquid, which is the source of the liquid nitrogen product, is required to contain less than 100 parts per million (ppm) argon and possibly as little as 10 ppm argon. The typical argon concentration in the shelf liquid nitrogen of a conventional cryogenic air separation plant is more than 1000 ppm when the oxygen content of the shelf is maintained at about 1 ppm. Heretofore, in order to reduce the argon content of the shelf, the reflux ratio (L/V) within the higher pressure column must be increased.

The conventional way of increasing L/V without altering the total higher pressure column stage count is to increase the purity specification of shelf nitrogen, i.e. reduce its oxygen content below 1 ppm, to the value that conforms with the required argon specification. This is accomplished by significantly decreasing the flow rate of shelf liquid that is used as reflux in the lower pressure column. As a result, the overall argon recovery is decreased. Attempts to compensate for the loss of argon recovery due to lack of reflux to the lower pressure column by adding liquid to the top of the lower pressure column to make up for the reduced liquid reflux cannot improve argon recovery beyond conventional levels.

Accordingly it is an object of this invention to provide a cryogenic rectification system which produces nitrogen having a low argon content without losing a significant amount of reflux for the lower pressure column.

It is another object of this invention to provide a cryogenic rectification system which enables an overall improvement is argon recovery.

SUMMARY OF THE INVENTION

The above and other objects, which will become apparent to one skilled in the art upon a reading of the disclosure, are attained by the present invention, one aspect of which is:

A cryogenic rectification method for producing nitrogen having a low argon content comprising:

(A) passing feed air into a higher pressure column of a double column which also includes a lower pressure column and separating the feed air within the higher pressure column into nitrogen-enriched fluid and into oxygen-enriched fluid;

(B) passing oxygen-enriched fluid and nitrogen-enriched fluid from the higher pressure column into the lower pressure column;

(C) withdrawing nitrogen-containing vapor from the higher pressure column at a level from 3 to 10 equilibrium stages below the top of the higher pressure column;

(D) liquefying the withdrawn nitrogen-containing vapor to produce liquefied nitrogen and passing the liquefied nitrogen into the higher pressure column at a level within 5 equilibrium stages of the level from which the nitrogen-containing vapor is withdrawn from the higher pressure column and below the top of the higher pressure column; and (E) recovering a portion of the nitrogen-enriched fluid as low argon content nitrogen product.

Another aspect of the invention is:

A cryogenic rectification apparatus for producing nitrogen having a low argon content comprising:

(A) a double column comprising a first column and a second column, and means for passing feed air into the first column;

(B) means for passing fluid from the first column into the second column;

(C) a liquefier and means for passing vapor withdrawn from the first column at a level from 3 to 10 equilibrium stages below the top of the first column to the liquefier;

(D) means for passing liquid from the liquefier to the first column at a level within 5 equilibrium stages of the level from which the vapor is withdrawn from the first column and below the top of the first column; and (E) means for recovering product fluid from the first column.

As used herein the term "top condenser" means a heat exchange device which generates column downflow liquid from column top vapor. A top condenser is generally located within the column but may be physically outside the column.

As used herein, the term "feed air" means a mixture comprising primarily nitrogen, oxygen and argon, such as ambient air.

As used herein, the terms "turboexpansion" and "turboexpander" means respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the terms "upper portion" and "lower portion" of a column means respectively that portion of the column above and below the midpoint of the column.

As used herein, the term "argon column" means a column which processes a feed containing argon and produces a product fluid having an argon concentration which exceeds that of the feed.

DETAILED DESCRIPTION

The invention not only produces nitrogen having a low argon content but also enables an improved overall argon recovery. In the practice of the invention liquefied nitrogen from a liquefier is introduced to the higher pressure column below the top of the higher pressure column. Cold nitrogen-enriched vapor recycling through the heat exchangers of the liquefier and the primary heat exchanger of the air separation plant is withdrawn from the higher pressure column. This results in the addition of a high efficiency partial condenser that condenses some of the nitrogen-enriched vapor rising within the higher pressure column. As a result the L/V above this point in the upper stages of higher pressure column is modified due to this virtual partial condenser. The argon content in the shelf liquid is reduced to a very low level, as low as 10 ppm, with only a slight decrease in the amount of shelf liquid available. Liquid nitrogen product, which splits from the shelf liquid, has this same low argon content. The low argon content shelf liquid also reduces the equilibrium argon content of nitrogen-rich vapor rising from the top of lower pressure column. The decrease in equilibrium argon content at this point and throughout the lower pressure column rectifying section minimizes the argon loss through the nitrogen streams leaving the lower pressure column. As a result, overall argon recovery is improved by up to 3 percent or more over conventional arrangements.

Figure 1:
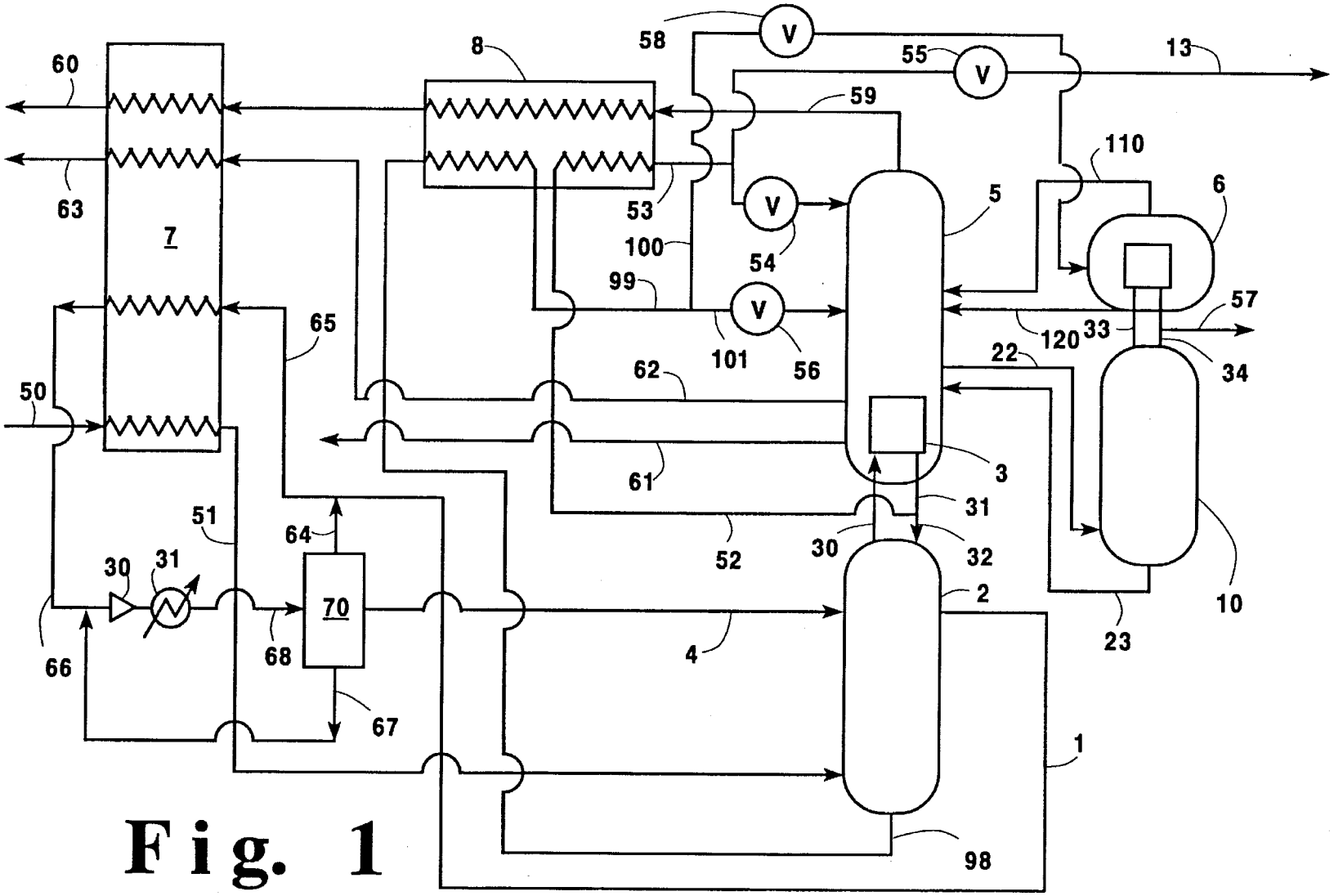
FIG. 1 is a schematic flow diagram of one preferred embodiment of the cryogenic rectification system of the invention.

The invention will be described in further detail with reference to the drawings. Referring now to FIG. 1, feed air 50 which has been cleaned of high boiling impurities such as water vapor and carbon dioxide and which is at a pressure generally within the range of from 70 to 150 pounds per square inch absolute (psia), is cooled by indirect heat exchange with return streams in main heat exchanger 7. Resulting cooled stream 51 is passed into first or higher pressure column 2 which is part of a double column system which also comprises second or lower pressure column 5.

Higher pressure column 2 is operating at a pressure generally within the range of from 70 to 145 psia. Within higher pressure column 2 the feed air is separated by cryogenic rectification into nitrogen-enriched fluid and oxygen-enriched fluid. Nitrogen-enriched fluid is passed as vapor in stream 30 from the top of column 2 into main condenser 3 wherein it is condensed by indirect heat exchange with boiling lower pressure column 5 bottom liquid. A first portion 32 of resulting nitrogen-enriched liquid 31 is passed into higher pressure column 2 as reflux. A second portion 52 of nitrogen-enriched liquid 31 is subcooled by partial traverse of heat exchanger 8 and resulting stream 53 is passed through valve 54 and into lower pressure column 5 as reflux. A portion 13 of the nitrogen-enriched liquid is passed through valve 55 and recovered as product liquid nitrogen.

Oxygen-enriched fluid is withdrawn as liquid from the lower portion of higher pressure column 2 in stream 98 and subcooled by partial traverse of heat exchanger 8. Resulting oxygen-enriched liquid 99 is divided into first portion 101 and into second portion 100. First oxygen-enriched liquid portion 101 is passed through valve 56 into lower pressure column 5.

A stream 22, generally comprising from about 5 to 25 mole percent argon with the remainder being mostly oxygen, is passed from lower pressure column 5 into argon column 10 wherein it is separated by cryogenic rectification into argon-richer vapor and oxygen-richer liquid. Oxygen-richer liquid is withdrawn from argon column 10 as stream 23 and passed into lower pressure column 5. Argon-richer vapor 33 is passed into argon column top condenser 6 wherein it is condensed by indirect heat exchanger with oxygen-enriched liquid second portion 100 which has been passed there through valve 58. Resulting argon-richer liquid 34 is passed into argon column 10 as reflux. A portion of the argon-richer fluid is recovered as product argon having an argon concentration generally within the range of from 95 to 100 mole percent. The argon-richer fluid may be recovered as vapor and/or liquid. The embodiment of the invention illustrated in FIG. 1 illustrates the recovery of the argon-richer fluid as liquid in stream 57.

The second portion of the oxygen-enriched liquid is partially vaporized by indirect heat exchanger with argon-richer vapor in top condenser 6 to produce oxygen-enriched vapor 110, which is passed from top condenser 6 into lower pressure column 5, and remaining oxygen-enriched liquid which is passed from top condenser 6 into lower pressure column 5 in stream 120.

Lower pressure column 5 is operating at a pressure less than that of higher pressure column 2 and generally within the range of from 15 to 35 psia. Within lower pressure column 5 the various feeds are separated by cryogenic rectification into nitrogen-rich vapor and oxygen-rich fluid. Nitrogen-rich vapor is withdrawn from the upper portion of lower pressure column 5 in stream 59, warmed by passage through heat exchangers 8 and 7, and removed from the system in stream 60 which may be recovered in whole or in part. Oxygen-rich fluid may be recovered as vapor and/or liquid. The embodiment illustrated in FIG. 1 has both vapor and liquid recovery. Oxygen-rich liquid is withdrawn from lower portion of lower pressure column 5 and recovered in stream 61. Oxygen-rich vapor is withdrawn from the lower portion of lower pressure column 5 in stream 62, warmed by passage through main or primary heat exchanger 7 and recovered in stream 63. The oxygen-rich fluid has an oxygen concentration within the range of from 98 to 99.95 mole percent.

The invention enables the production of nitrogen-enriched vapor or shelf vapor, which may be withdrawn from the top of the higher pressure column, having an argon content significantly below that possible with conventional systems and generally within the range of from 10 to 100 ppm. This enables the production and recovery of liquid nitrogen, such as in stream 13, having a nitrogen concentration equal to or greater than 99 mole percent and having a low argon content, less than 1000 ppm and generally within the range of from 10 to 100 ppm. The invention accomplishes this by liquefying nitrogen-enriched vapor from the higher pressure column in a liquefier and returning the liquefied nitrogen to the higher pressure column at a level within 5 equilibrium stages of the withdrawal level but below the product withdrawal level, thus modifying, i.e. decreasing, the reflux ratio within the higher pressure column above the vapor withdrawal level. This, in turn, causes argon within the higher pressure column to more preferentially pass downward thus freeing the nitrogen taken from the top part of the higher pressure column from having a conventional argon content.

Referring back now to FIG. 1, nitrogen-containing vapor stream 1 is withdrawn from higher pressure column 2 at a level from 3 to 10 equilibrium stages below, most preferably about 5 equilibrium stages below, the top of column 2. Stream 1 has a nitrogen concentration generally within the range of from 99 to 99.999 mole percent. A cold vapor stream 64 from liquefier 70 is passed into stream 1 and resulting combined stream 65 is warmed by passage through heat exchanger 7. Resulting stream 66 is then combined with warm vapor stream 67 from liquefier 70 to form liquefier feed stream 68 which is compressed through compressor 30, cooled of heat of compression through cooler 31 and passed into liquefier 70 and liquefied. Resulting liquefied nitrogen stream 4 is passed from liquefier 70 into higher pressure column 2 at a level within 5 equilibrium stages above or below the level from which vapor stream 1 is withdrawn from column 2. Preferably stream 4 is passed into column 2 at the same level as stream 1 is withdrawn from column 2. By same level it is meant the same tray or equilibrium stage. Stream 4 is passed into column 2 below the level from which the nitrogen product stream, e.g. stream 30, is withdrawn from column 2. Preferably stream 4 is passed into column 2 at a level from 3 to 5 equilibrium stages below the top of column 2.

A liquefier is an apparatus which produces a liquid stream from a vapor stream. A liquefier particularly useful in the practice of the invention is comprised of heat exchangers, compressors and expanders. One such liquefier known in the art is disclosed in U.S. Pat. No. 4,778,497—Hanson et al. Any suitable liquefier may be used in the practice of this invention.

Figure 2:
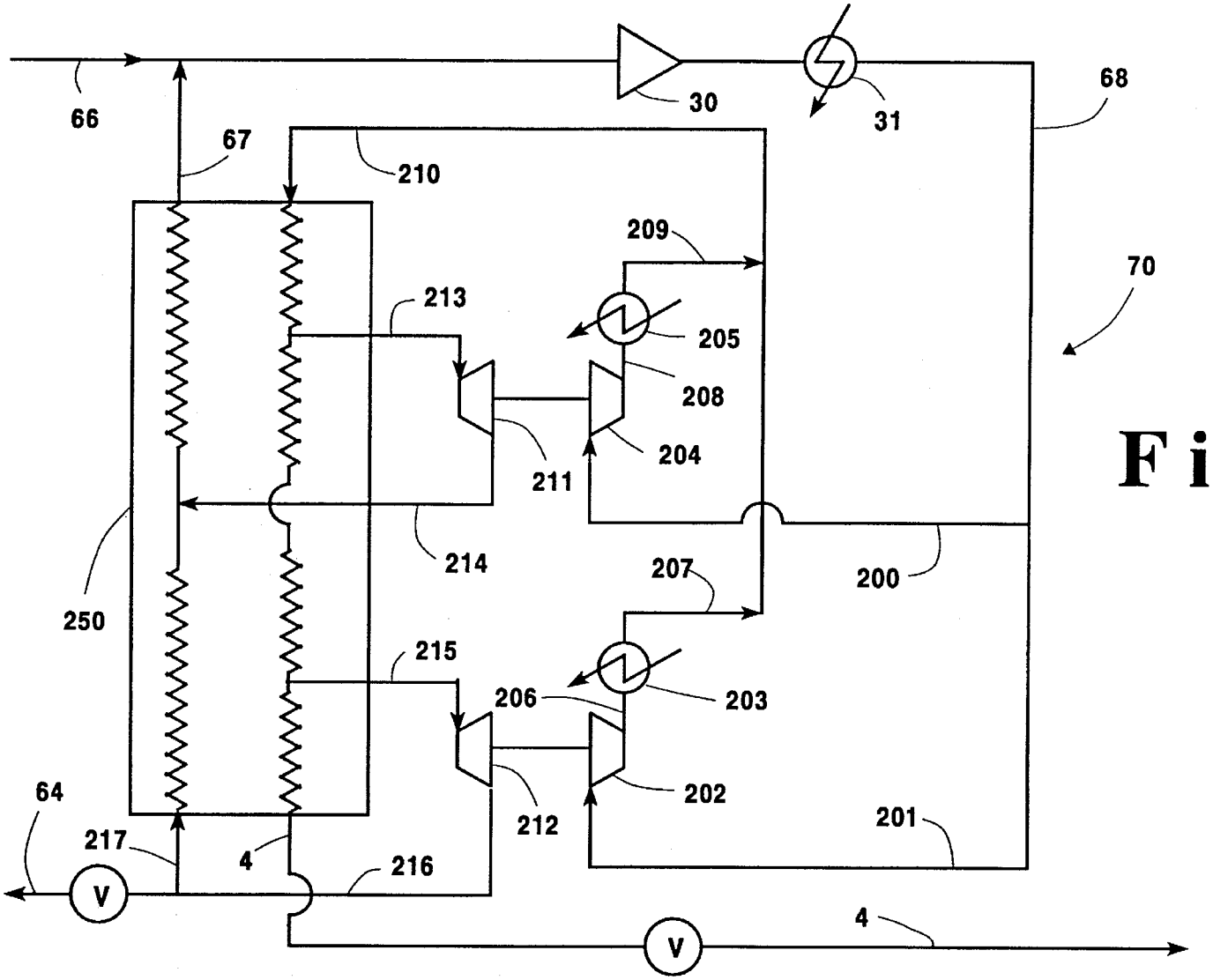
FIG. 2 is a schematic flow diagram of one embodiment of a liquefier which may be used in the practice of the invention.

FIG. 2 illustrates one embodiment of liquefier 70. The numerals in FIG. 2 correspond to those of FIG. 1 for the common elements. Referring now to FIG. 2, nitrogen stream 66 is combined with stream 67 from heat exchanger 250 of liquefier 70, and the resulting combined stream is introduced to recycle compressor 30 wherein it is compressed to a pressure of about 450 psia. Following the compression the nitrogen is cooled against cooling water in aftercooler 31 and resulting stream 68 is passed into liquefier 70.

Within liquefier 70 stream 68 is divided into streams 200 and 201. Stream 200 is compressed within warm booster compressor 204 which is mechanically coupled to warm turboexpander 211. Similarly, stream 201 is compressed within cold booster compressor 202 which is mechanically coupled to cold turboexpander 212. The resulting streams 208 and 206 are cooled in aftercoolers 205 and 203 respectively and the respective resulting streams 209 and 207 are combined to form stream 210 which has a pressure of about 800 psia.

Stream 210 is introduced into heat exchanger 250 wherein it is cooled by indirect heat exchange against medium pressure nitrogen stream 217 which is at a pressure of about 85 psia. As stream 210 is cooled it is divided into stream 213 which is expanded in warm turbine 211 to give stream 214. Stream 214 is then combined with stream 217. At a lower temperature the remainder of stream 210 is again divided to give stream 215 which is expanded in cold turbine 212 to give stream 216. Stream 216 is divided to give stream 64 and the aforesaid stream 217. Stream 64 is combined with stream 1 as has been previously described. The remainder of stream 210 is passed out of heat exchanger 250 as stream 4 which is returned to column 2 as has been previously described.

The invention not only produces nitrogen having a low argon content but also increases the overall recovery of argon from an argon column because argon losses from the upper portion of the lower pressure column are reduced. Three computer simulations of the method of this invention in accord with the embodiment illustrated in FIG. 1 were carried out and the results are shown in Table I in columns A, B, and C. For comparative purposes a conventional system was also computer simulated and the results are shown in Table I in column D.

TABLE I

| | A | B | C | D |
|---|---|---|---|---|
| Argon in Shelf Liquid (ppm) | 100 | 50 | 20 | 1031 |
| Argon Recovery (%) | 94.4 | 94.6 | 95.2 | 91.1 |

As can be seen by the experimental results reported in Table I, by the use of this invention one can produce low argon content nitrogen by cryogenic rectification of feed air while also enabling enhanced recovery of argon. Although the invention has been described in detail with reference to a certain preferred embodiment, those skilled in the art will recognize that there are other embodiments of the invention within the spirit and the scope of the claims.

We claim:

1. A cryogenic rectification method for producing nitrogen having a low argon content comprising:

(A) passing feed air into a higher pressure column of a double column which also includes a lower pressure column and separating the feed air within the higher pressure column into nitrogen-enriched fluid and into oxygen-enriched fluid;

(B) passing oxygen-enriched fluid and nitrogen-enriched fluid from the higher pressure column into the lower pressure column;

(C) withdrawing nitrogen-containing vapor from the higher pressure column at a level from 3 to 10 equilibrium stages below the top of the higher pressure column;

(D) liquefying the withdrawn nitrogen-containing vapor to produce liquefied nitrogen and passing the liquefied nitrogen into the higher pressure column at a level within 5 equilibrium stages of the level from which the nitrogen-containing vapor is withdrawn from the higher pressure column and below the top of the higher pressure column; and (E) recovering a portion of the nitrogen-enriched fluid as low argon content nitrogen product.

2. The method of claim 1 further comprising separating the fluids passed into the lower pressure column by cryogenic rectification into nitrogen-rich vapor and oxygen-rich fluid.

3. The method of claim 2 further comprising recovering nitrogen-rich vapor as product nitrogen.

4. The method of claim 2 further comprising recovering oxygen-rich fluid as product oxygen.

5. The method of claim 1 further comprising passing an argon-containing stream from the lower pressure column into an argon column, producing argon-richer fluid by cryogenic rectification within the argon column, and recovering argon-richer fluid from the argon column.

6. A cryogenic rectification apparatus for producing nitrogen having a low argon content comprising:

(A) a double column comprising a first column and a second column, and means for passing feed air into the first column;

(B) means for passing fluid from the first column into the second column;

(C) a liquefier and means for passing vapor withdrawn from the first column at a level from 3 to 10 equilibrium stages below the top of the first column to the liquefier;

(D) means for passing liquid from the liquefier to the first column at a level within 5 equilibrium stages of the level from which the vapor is withdrawn from the first column and below the top of the first column; and (E) means for recovering product fluid from the first column.

7. The apparatus of claim 6 further comprising means for recovering fluid from the upper portion of the second column.

8. The apparatus of claim 6 further comprising means for recovering fluid from the lower portion of the second column.

9. The apparatus of claim 6 further comprising an argon column, means for passing fluid from the second column to the argon column, and means for recovering fluid from the upper portion of the argon column.

10. The apparatus of claim 6 wherein the means for passing liquid from the liquefier to the first column communicates with the first column at the same level from which the vapor is withdrawn from the first column.

* * * * *